US011359340B2

(12) United States Patent
Pino, Jr.

(10) Patent No.: US 11,359,340 B2
(45) Date of Patent: Jun. 14, 2022

(54) MICROTRENCHING SYSTEM HAVING A VACUUM HOSE SUPPORT AND METHOD OF MICROTRENCHING

(71) Applicant: CCIIP LLC, New York, NY (US)

(72) Inventor: Angelo J. Pino, Jr., New York, NY (US)

(73) Assignee: CCIIP LLC, New York, NY (US)

( * ) Notice: Subject to any disclaimer, the term of this patent is extended or adjusted under 35 U.S.C. 154(b) by 0 days.

(21) Appl. No.: 17/350,025

(22) Filed: Jun. 17, 2021

(65) Prior Publication Data

US 2021/0395963 A1 Dec. 23, 2021

Related U.S. Application Data

(60) Provisional application No. 63/041,153, filed on Jun. 19, 2020.

(51) Int. Cl.
*E01C 23/09* (2006.01)

(52) U.S. Cl.
CPC ..... *E01C 23/096* (2013.01); *E01C 23/0933* (2013.01); *E01C 2301/50* (2013.01)

(58) Field of Classification Search
CPC . E01C 23/0933; E01C 23/096; E01C 2301/50
See application file for complete search history.

(56) References Cited

U.S. PATENT DOCUMENTS 3,541,631 A * 11/1970 Kluge ..... E01H 1/0836 15/340.1
4,151,688 A * 5/1979 Flynn ..... B66F 19/00 212/238
4,434,861 A 3/1984 Howeth
4,578,840 A * 4/1986 Pausch ..... E01H 1/0836 15/340.1
4,668,548 A 5/1987 Lankard
4,744,693 A 5/1988 Smith
4,812,078 A 3/1989 Rivard
4,881,362 A * 11/1989 Parker ..... A01D 43/077 56/202
4,909,575 A * 3/1990 Lupton ..... E01C 23/088 180/24.02

(Continued)

FOREIGN PATENT DOCUMENTS

CA 2348062 11/2001
WO 2016/088083 9/2016

OTHER PUBLICATIONS

Camplex Fiber Optic Extender, http://www.camplex.com/product.aspx?item=CMX-TACNGO-SDI, Oct. 17, 2017 pp. 1-2.

(Continued)

*Primary Examiner* — Abigail A Risic

(74) *Attorney, Agent, or Firm* — Jeffrey S. Melcher; Melcher Patent Law PLLC

(57) ABSTRACT

A microtrenching system having a vacuum hose supported between a vacuum truck and a microtrencher so that the vacuum hose does not contact the roadway surface while cutting the microtrench. A method of using the microtrenching system to cut a microtrench in a roadway and vacuuming spoil from the roadway and microtrench through the supported vacuum hose into a spoil container on the vacuum truck.

17 Claims, 6 Drawing Sheets

(56) References Cited

U.S. PATENT DOCUMENTS

| | | | | |
|---|---|---|---|---|
| 5,026,206 | A * | 6/1991 | O'Connor | E01C 19/025 404/77 |
| 5,244,304 | A | 9/1993 | Weil | |
| 5,263,790 | A * | 11/1993 | Bickley | E01C 23/06 404/107 |
| 5,832,178 | A * | 11/1998 | Schave | B05C 11/1042 392/472 |
| 5,913,638 | A | 6/1999 | Lansdale | |
| 7,914,618 | B1 | 3/2011 | Krozel | |
| 9,203,226 | B2 | 12/2015 | Miller | |
| 9,485,468 | B2 | 11/2016 | Pino | |
| 9,739,399 | B1 * | 8/2017 | Dundas | F16L 3/245 |
| 10,311,102 | B2 | 6/2019 | Pino | |
| 10,364,920 | B1 * | 7/2019 | Dundas | F16L 3/26 |
| 10,571,045 | B2 | 2/2020 | Pino | |
| 10,571,047 | B2 | 2/2020 | Pino | |
| 10,641,414 | B2 | 5/2020 | Pino | |
| 10,781,942 | B2 | 8/2020 | Pino | |
| 10,808,377 | B1 * | 10/2020 | Pino, Jr | E02F 3/9281 |
| 10,808,379 | B1 | 10/2020 | Pino | |
| 10,851,517 | B2 | 12/2020 | Pino | |
| 10,876,654 | B2 | 12/2020 | Pino | |
| 10,883,629 | B2 | 1/2021 | Pino | |
| 11,028,556 | B1 | 6/2021 | Pino | |
| 2004/0149174 | A1 | 8/2004 | Farrington | |
| 2005/0036749 | A1 | 2/2005 | Vogel | |
| 2005/0179308 | A1 * | 8/2005 | Gaertner | E01C 23/088 299/39.2 |
| 2005/0189127 | A1 | 9/2005 | Martin | |
| 2006/0249133 | A1 * | 11/2006 | Boyadjieff | B28D 1/045 125/13.01 |
| 2007/0096539 | A1 * | 5/2007 | Walker | E01C 23/0933 299/39.3 |
| 2013/0011198 | A1 | 1/2013 | Purcell | |
| 2013/0284070 | A1 | 10/2013 | Dubey | |
| 2015/0125218 | A1 | 5/2015 | Gustavsson | |
| 2016/0369610 | A1 | 12/2016 | Wright | |
| 2016/0376767 | A1 | 12/2016 | Miller | |
| 2018/0106015 | A1 | 4/2018 | Pino | |
| 2018/0126592 | A1 * | 5/2018 | Karam | B28C 9/0463 |
| 2018/0156357 | A1 | 6/2018 | Pino | |
| 2018/0292027 | A1 | 10/2018 | Pino | |
| 2019/0086002 | A1 | 3/2019 | Pino | |
| 2019/0136488 | A1 * | 5/2019 | Cochran | E01C 23/096 |
| 2019/0226603 | A1 | 7/2019 | Pino | |

OTHER PUBLICATIONS

Corning Fiber Optic Extenders, https://www.corning.com/worldwide/en/products/communication-networks/products/fiber.html, Oct. 17, 2017 pp. 1-7.

SC Polymer, https://www.surecretedesign.com/product/liquid-concrete-polymer/, Oct. 17, 2017 p. 1.

SCAG Giant VAC, http://www.giant-vac.com/, Oct. 17, 2017pp. 1-2.

DR Power Vacuum, https://www.drpower.com/, Oct. 17, 2017pp. 1-2.

Billy Goat vaccum, www.billygoat.com, Oct. 17, 2017pp. 1-2.

Ditch Witch, www.ditchwitch.com, Oct. 17, 2017p. 1.

Trenchers, www.vermeer.com,Oct. 17, 2017 pp. 1-15.

Trenchers, www.samarais.com, Oct. 17, 2017pp. 1-2 .

King, "Google Fiber finishes digging very shallow grave in Louisville, KY. #RIP," https://www.pocketables.com/2019/021 Joogle-fiber-finishes-digging-very-shallow-grave-in-louisville-ky-rip.html, published on Pocketable on Feb. 7, 2019, pp. 1-9.

Blum, "Microtrenching fail drives Google Fiber out of Louisville," https:lwww.tellusventure.com/blog/microtrenching- ail-drives-google-fiber--out-of-louisville/, published on Tellus Venture Associates, Feb. 8, 2019, pp. 1-3.

Otts, "Where is Google Fiber? Mostly in the Highlands, records show," hllps://www.wdrb.com/news/business/sunday- 3edition-where-is-google-fiber-moslly-in-the-highlands/article _ 569112e0-421 e-58ef-be24-c2e42e5e53d2.html, published in the Sunday Edition, WDRB, Sep. 14, 2018, pp. 1-10.

FASTRACT 400 material data sheet Aug. 23, 2018, pp. 1-4.

https://www.youtube.com/watch?v=0CGi92UK4Tw, Optic Fiber nastro in Torino, published Mar. 7, 2016, Garbin Group, pp. 1-3.

https://www.youtube.com/watch?v=klWluvLc5cl, The Ditch Witch MT12 MicroTrencher: Faster, Cleaner, Better, published Jun. 14, 2016, pp. 1-4.

https://www.youtube.com/watch?v=VWryq2nOA3U, Micro trenching | MTT-system, published Sep. 26, 2016, www.mttsystem.com, pp. 1-3.

https://www.youtube.com/watch?v=7xf2Ujax9hU, published Nov. 10, 2011, Micro-Trenching—alternative Möglichkeit zur Verlegung von Glasfaserkabeln, Schmidt@buglas.de, pp. 1-3.

https://www.youtube.com/watch?v=OlxA3gqNPkE, BVS-net, microtrenching, published Nov. 29, 2014, www. bvs-net.eu, pp. 1-3.

https://www.youtube.com/watch?v=929vJtv5Uxw, www, dellcron.com, published Feb. 10, 2018, pp. 1-3.

https://www.youtube.com/watch?v=8p4xHlwuMhl, Americicom, www.americomtech.com, Microtrenching, published Jun. 10, 2017, pp. 1-3.

https://www.youtube.com/watch?v=57NBkB1y8iM, published Jan. 14, 2014, KNET Micro Trenching Solution, pp. 1-4.

Geophysical Survey Systems, www.geophysical.com/products, pp. 1-23, 2020.

UtilityScan DF, quick start guide, MN72-489, pp. 1-68, pp. 2017-2018.

* cited by examiner

MICROTRENCHING SYSTEM HAVING A VACUUM HOSE SUPPORT AND METHOD OF MICROTRENCHING

FIELD OF THE INVENTION

The invention generally relates to a microtrencher system having a vacuum hose support and a method of microtrenching using the microtrencher system.

BACKGROUND OF THE INVENTION

The microtrencher saw usually creates a pile of spoil (dirt, asphalt, concrete, etc.) alongside the formed microtrench and the microtrench must be carefully cleaned before laying the cable in the trench. The pile of spoil must then be removed. A fill, also referred to as cement or grout, is inserted into the trench on top of the cable or innerduct/microduct.

Industrial vacuum trailers have been used to remove the piled up spoil or suck up the spoil as it being created by the saw. However, the industrial vacuum trailers are slow, inefficient and do not provide a clean microtrench, especially when creating a microtrench more than 16 inches deep. Furthermore, the vacuum hoses are bent, often dragged and are in the way causing undesirable delays in microtrenching.

Installing new optical fiber networks in a city is expensive and time consuming. Many installations require a far deeper microtrench to provide enhanced protection, such as more than 16 inches deep, and often up to 26 inches deep. When cutting a deep microtrench, cleaning spoil from the microtrench is far more difficult. There is a great need for faster and less expensive installation of optical fiber networks.

SUMMARY OF THE INVENTION

The invention relates to a microtrencher system having hose supports to provide a vacuum hose having straighter path between the vacuum inlet near the microtrencher and the vacuum device. The hose supports prevent the vacuum hose from dragging on the roadway surface. The hose supports keep the vacuum hose out of the way of the working crew to avoid undesirable disruptions in cutting the microtrench.

The above objectives and other objectives can be obtained by a microtrencher system configured for continuously cutting a microtrench in a roadway and cleaning spoil from the microtrench comprising:

- a first motorized vehicle comprising a spoil storage container and a vacuum device configured to form a vacuum in the spoil storage container;
- a second motorized vehicle following the first motorized vehicle;
- a microtencher connected to the second motorized vehicle, the microtrencher having a cutting wheel configured to cut a microtrench in a roadway;
- a vacuum shroud positioned behind the cutting wheel and configured to vacuum up the spoil created by the cutting wheel;
- a vacuum hose having a first end and a second end, a first end of the vacuum hose connected to the spoil storage container, and the second end of the vacuum hose connected to the vacuum shroud; and
- a first hose support between the first motorized vehicle and second motorized vehicle configured for supporting the vacuum hose above a roadway surface.

The above objectives and other objectives can also be obtained by a method of continuously cutting a microtrench in a roadway comprising:

- providing a microtrenching system comprising a first motorized vehicle comprising a spoil storage container and a vacuum device configured to form a vacuum in the spoil storage container;
  - a second motorized vehicle following the first motorized vehicle;
  - a microtencher connected to the second motorized vehicle, the microtrencher having a cutting wheel configured to cut a microtrench in a roadway;
  - a vacuum shroud positioned behind the cutting wheel and configured to vacuum up spoil created by the cutting wheel;
  - a vacuum hose having a first end and a second end, a first end of the vacuum hose connected to the spoil storage container, and the second end of the vacuum hose connected to the vacuum shroud; and
  - a first hose support between the first motorized vehicle and the second motorized vehicle configured for supporting the vacuum hose above a roadway surface;
- driving the first and second motorized vehicles forward while cutting the microtrench in the roadway with the cutting wheel to form the microtrench and the spoil;
- supporting the vacuum hose between the first and second motorized vehicles using the first hose support so that the vacuum hose does not contact the roadway surface; and
- vacuuming the spoil through the shroud, through the vacuum hose, and into the spoil storage container.

DETAILED DESCRIPTION OF THE INVENTION

Figure 1:
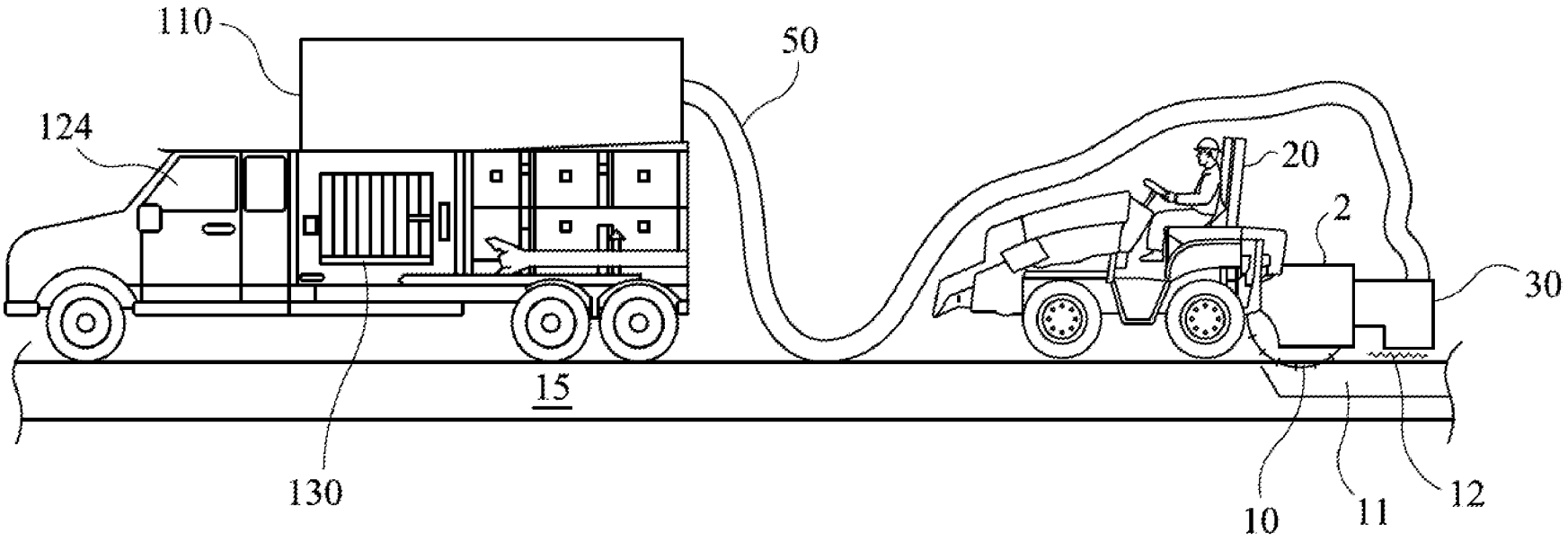
FIG. 1 [PRIOR ART]
FIG. 1 [Prior Art] illustrates a prior art microtrenching system in which the vacuum hose can contact the roadway surface.

In the following description, for purposes of explanation and not limitation, specific details are set forth, such as particular networks, communication systems, computers, terminals, devices, components, techniques, data and network protocols, software products and systems, operating systems, development interfaces, hardware, etc. in order to provide a thorough understanding of the present invention with reference to the attached non-limiting figures.

However, it will be apparent to one skilled in the art that the present invention may be practiced in other embodiments that depart from these specific details. Detailed descriptions of well-known networks, communication systems, computers, terminals, devices, components, techniques, data and network protocols, software products and systems, operating systems, development interfaces, and hardware are omitted so as not to obscure the description.

During installation of the optical fiber, a microtrencher system is used to cut a microtrench in the roadway, vacuum the spoil from the microtrench, lay an optical fiber and/or innerduct/microduct in the microtrench, and then filling the microtrench with a fill and sealant over the optical fiber and/or innerduct/microduct to protect them from the environment. The microtrencher system includes a vacuum truck, a motorized vehicle, a microtrencher, and a shroud.

Microtrenchers, other devices used in microtrenching, and methods of microtrenching that can be utilized in the present invention include the devices and methods described in my previous U.S. patent publication Nos. 20190226603, 20190086002, 20180292027, 20180156357, and 20180106015, the complete disclosures of which are incorporated in their entirety herein by reference.

Any suitable microtrencher 2 can be utilized in the present invention. Non-limiting examples of suitable micro trenchers include those made and sold by Ditch Witch, Vermeer, and Marais. A Vermeer RTX 1250 tractor can be used as the motorized vehicle for the microtrencher 2. A microtrencher 2 is a "small rock wheel" specially designed for work in rural or urban areas. The microtrencher 2 is fitted with a cutting wheel 10 that cuts a microtrench 11 with smaller dimensions than can be achieved with conventional trench digging equipment. Microtrench 11 widths usually range from about 6 mm to 130 mm (¼ to 5 inches) with a depth of 750 mm (about 30 inches) or less. Other widths and depths can be used as desired.

With a microtrencher 2, the structure of the road, sidewalk, driveway, or path is maintained and there is no associated damage to the road. Owing to the reduced microtrench 11 size, the volume of waste material (spoil 12) excavated is also reduced. Microtrenchers 2 are used to minimize traffic or pedestrian disturbance during cable laying. A microtrencher 2 can work on sidewalks or in narrow streets of cities, and can cut harder ground than a chain trencher, including cutting through for example but not limited to solid stone, concrete, and asphalt. The term ground as used herein includes, son, asphalt, stone, concrete, grass, dirt, sand, brick, cobblestone, or any other material the trench 11 is cut into and the optical fiber buried within.

Figure 2:
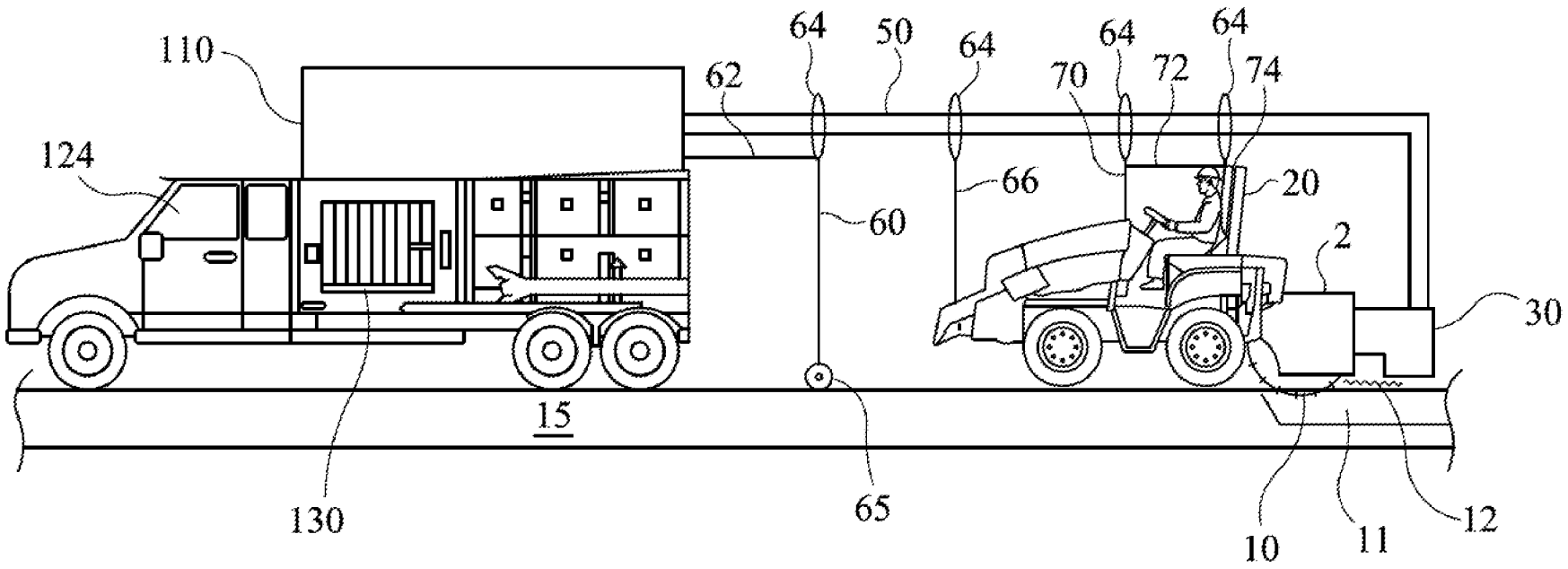
FIG. 2 illustrates a microtrenching system in which the vacuum hose is supported above the roadway.

FIG. 2 shows an embodiment of the microtrencher system. A microtrencher 2 is used to cut a microtrench 11 and produce spoil 12. A vacuum shroud 30 is used to vacuum up the spoil 12. Any type of shroud 30 can be utilized, including those describe in my copending U.S. patent application Ser. No. 16/806,335, the complete disclosure of which is incorporated herein by reference. The shroud 30 is connected to a vacuum truck 124 by a vacuum hose 50. The spoil 12 is sucked up into the shroud 30, travels through the hose 50 and into the spoil storage container 110. A vacuum is created in the storage container 110 by a source of vacuum 130. Preferably the hose 50 is flexible.

As shown in FIG. 1 [Prior Art], in a conventional microtrenching system, the hose 50 can drag on the roadway surface and is not aligned in a substantially straight path. To solve this problem, hose supports 60, 66, 70, and 72 can be used to support the hose 50 so that the hose 50 cannot drag on the roadway 15, and to provide a straighter path between the shroud 30 and the storage container 110. While a straight path for the hose 50 is shown in FIG. 2, in use there will most likely be small dips in the hose 50 between the hose supports 60, 66, 70, and 72. The supports include hose holders 64 for keeping the vacuum hose 50 in place.

Figure 3:
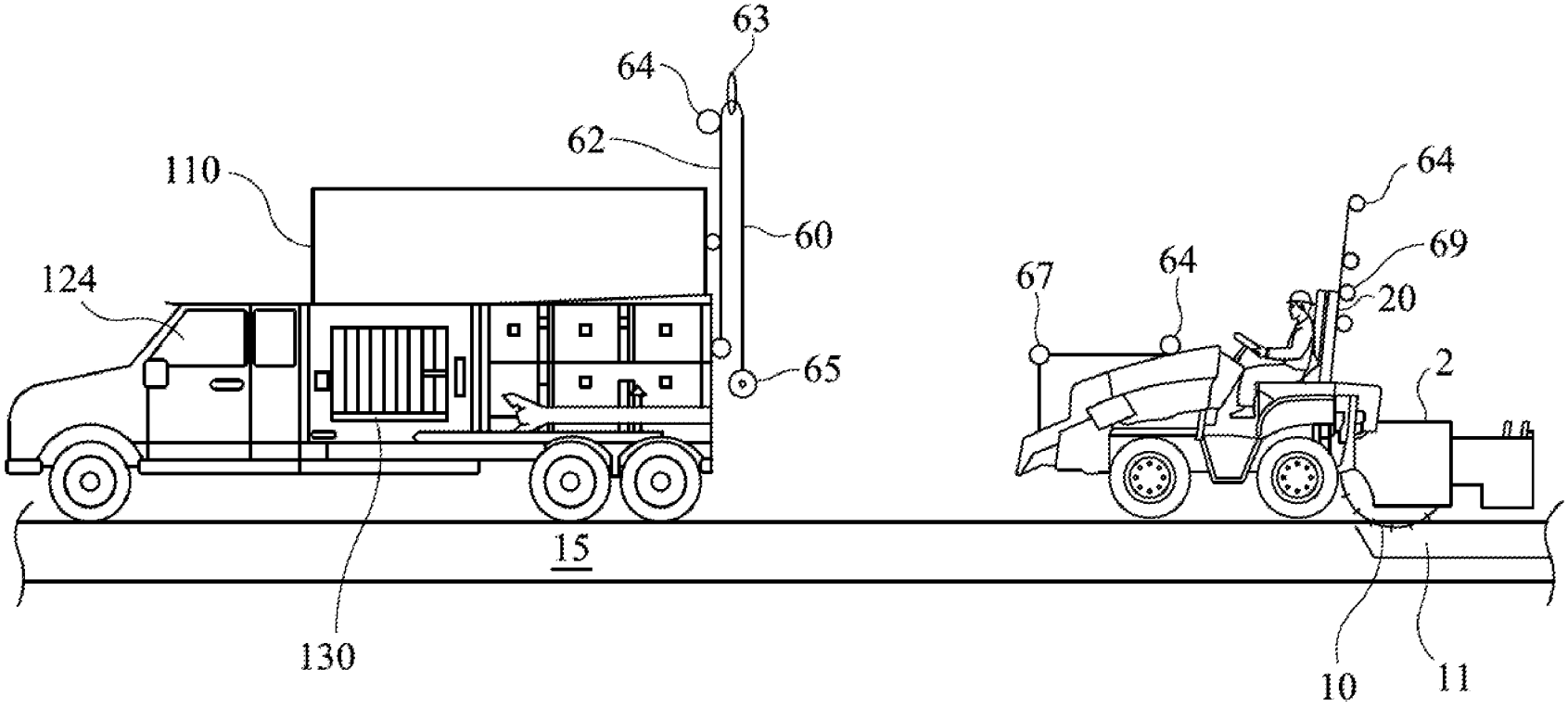
FIG. 3 illustrates the vacuum hose supports in folded positions.

The First support 60 can have at least one wheel 65 for driving on the roadway 15 and at least one hose holder 64. The first support 60 can be connected to the first vehicle 124 by a first connector 62. The connector 62 can also support the vacuum hose 50. The first support 60 can be connected to the first connector 62 by a hinge 63 so that the first support 60 can fold up into a storage position on the first vehicle 124 as shown in FIG. 3. The first connector 62 can be connected to the top or side of the vacuum truck 124, as desired.

The second support 66 can be mounted to the second vehicle 20 and have at least one associated hose holder 64. The second support 66 can have a hinge 67 to allow the second support 66 to move into a storage position as shown in FIG. 3.

The third support 70 can be mounted to the second vehicle 20 have at least one associated hose holder 64. The third support 70 can include a third connector 72 connected to the second vehicle 20. The third support 70 and/or the third connector 72 can have at least one hinge 69 to allow the third support 70 and third connector 72 to move into a storage position as shown in FIG. 3. The third connector 72 can also support the vacuum hose 50 and have at least one hose holder 64. The second support 66 and third support 70 can be over the top of the microtencher 2, or to a side of the microtrencher 2.

Figure 4:
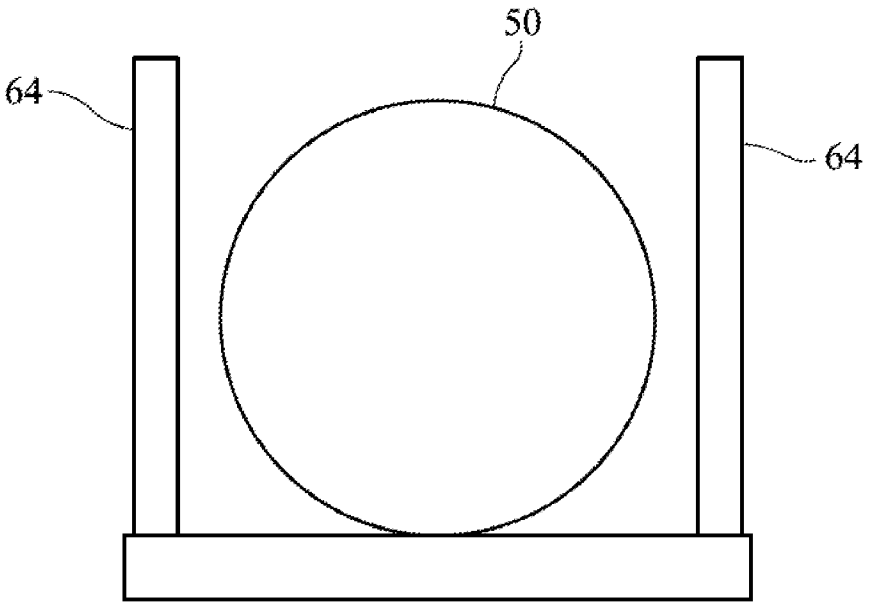
FIG. 4 illustrates a side view of a vacuum hose support.

FIG. 4 shows a view of the hose holder 64, which preferably can hold a vacuum hose 50 having a diameter from ½ to 12 inches.

Figure 5A:
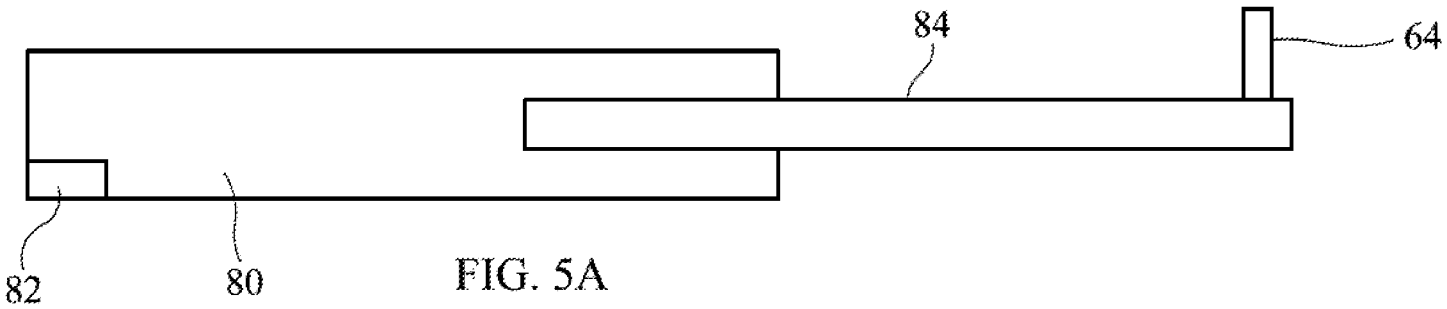
FIG. 5A illustrates a view of a vacuum hose support in the extended position.
Figure 5B:
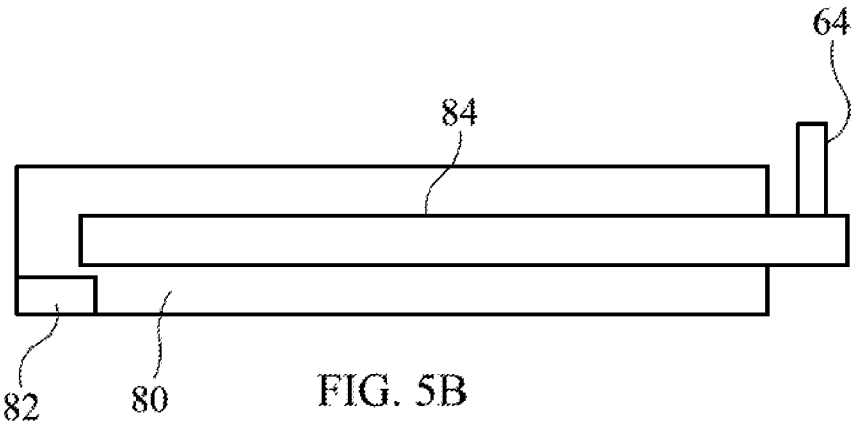
FIG. 5B illustrates a view of a vacuum hose support in a storage position.

In an alternative embodiment, the vacuum hose supports can slide out from a support storage container as shown in FIG. 5A (extended) and 5B (storage position). The support 84 is moveable from an extended position in FIG. 5A, where the support 84 extends from the support storage container 80 to a storage position in Fig. B where the support 84 is withdrawn into the support storage container 80. The movement of the support 84 can be manually or power driven 82, such as spring, hydraulic, electric or pneumatic.

As shown in FIGS. 2-3, the first hose support 60 and second hose support 66 can be unconnected to allow the first motorized vehicle 124 and the second motorized vehicle 20 to move independent of each other, such as while turning or going over bumps.

Figure 6:
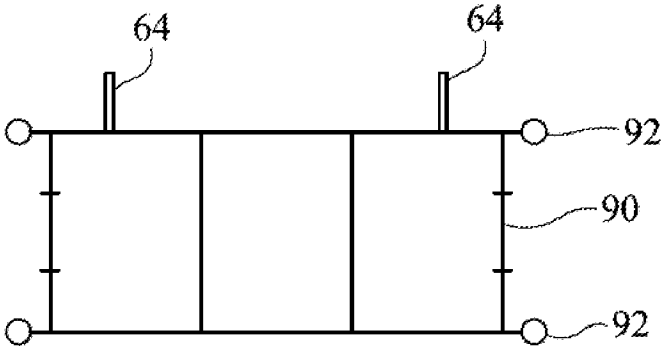
FIG. 6 illustrates a ladder type hose support.

In another embodiment, as shown in FIG. 6 the vacuum hose supports can be in form of sections 90 like a ladder having connectors 92. The sections 90 can be stored on the side of the first motorized vehicle 124, and during use taken off the side and hooked into the back and clipped together in various lengths using the connectors 92.

Figure 7:
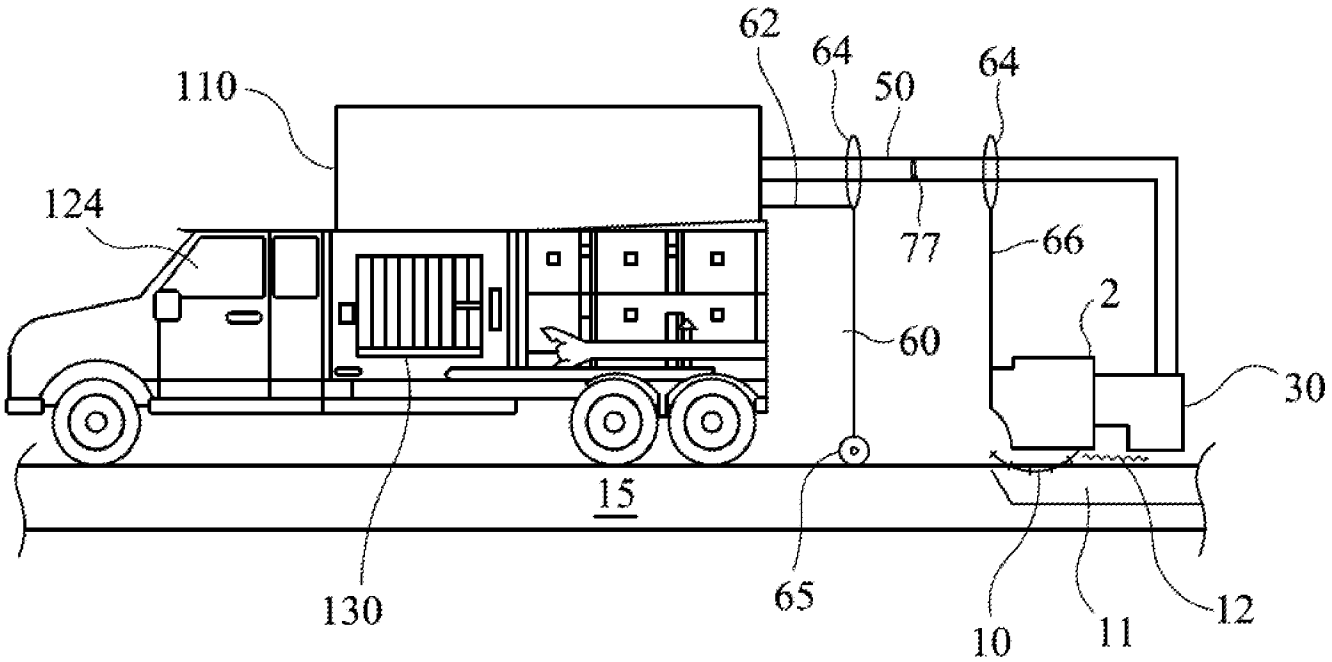
FIG. 7 illustrates the first motor vehicle diving the microtrencher.

Alternatively, the first hose support 60 can be connected to the second hose support 66 support by a movable connector 77 that allows the first motorized vehicle 124 and the second motorized vehicle 20 to move independent of each other. The movable connector 77 can allow pivoting between the first hose support 60 and the second hose support 66. In an additional embodiment, shown in FIG. 7 the first motorized vehicle 124 can also comprise the second motorized vehicle 20 so that microtrencher 2 is driven forward by being connected to the first motorized vehicle 124 by the connected first hose support 60 and the second hose support 66 where the second hose support 66 is connected to the microtrencher 2.

The purpose of this hose stabilization system is to allow the hose to be straight thus cutting back on clogs from all the dips it makes the current way it is used. This also helps cut down manpower because one or two workers have to constantly move the hose with the saw and vac to help if from getting clogged up with the debris.

The source of vacuum 130 can be any desired vacuum device, such as those made by SCAG Giant Vac., DR Power, Vermeer, and Billy Goat. A preferred vacuum truck 124 is a Guzzler vacuum truck, www.guzzler.com. The Guzzler type vacuum truck 124 has a large storage container 110 for holding spoil 12 and a vacuum device 130 for creating a vacuum in the storage container 110. The storage container 110 is sized to hold spoil 12 created by the side-discharge cutting wheel 10 cutting a microtrench 11 in the roadway 15.

To facilitate an understanding of the principles and features of the various embodiments of the present invention, various illustrative embodiments are explained below. Although example embodiments of the present invention are explained in detail, it is to be understood that other embodiments are contemplated. Accordingly, it is not intended that the present invention is limited in its scope to the details of construction and arrangement of components set forth in the following description or examples. The present invention is capable of other embodiments and of being practiced or carried out in various ways.

As used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the example embodiments, terminology will be resorted to for the sake of clarity. It is intended that each term contemplates its broadest meaning as understood by those skilled in the art and includes all technical equivalents that operate in a similar manner to accomplish a similar purpose.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified. Such other components or steps not described herein can include, but are not limited to, for example, similar components or steps that are developed after development of the disclosed technology.

It is to be understood that the foregoing illustrative embodiments have been provided merely for the purpose of explanation and are in no way to be construed as limiting of the invention. Words used herein are words of description and illustration, rather than words of limitation. In addition, the advantages and objectives described herein may not be realized by each and every embodiment practicing the present invention. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention.

The invention claimed is:

1. A microtrenching system configured for continuously cutting a microtrench in a roadway and cleaning spoil from the microtrench comprising:

a first motorized vehicle comprising a spoil storage container and a vacuum device configured to form a vacuum in the spoil storage container;

a second motorized vehicle following the first motorized vehicle;

a microtrencher connected to the second motorized vehicle, the microtrencher having a cutting wheel configured to cut a microtrench in a roadway;

a vacuum shroud positioned behind the cutting wheel and configured to vacuum up the spoil created by the cutting wheel;

a vacuum hose having a first end and a second end, a first end of the vacuum hose connected to the spoil storage container, and the second end of the vacuum hose connected to the vacuum shroud;

a first hose support between the first motorized vehicle and second motorized vehicle configured for supporting the vacuum hose above a roadway surface; and a second hose support connected to the second vehicle configured for supporting the vacuum hose above a roadway surface.

2. The microtrenching system according to claim 1, wherein the first hose support comprises a wheel configured to drive on the roadway surface.

3. The microtrenching system according to claim 1, wherein the first hose support is connected to the first motorized vehicle and is configured to move from a storage position on the first motorized vehicle to a use position in which the first hose support extends from a back of the first motorized vehicle.

4. The microtrenching system according to claim 1, wherein the second hose support is configured to move from a storage position on the second motorized vehicle to a use a position in which the second hose support extends upward from a front portion of the second motorized vehicle.

5. The microtrenching system according to claim 1, further comprising a third hose support connected to the second vehicle configured for supporting the vacuum hose above a roadway surface.

6. The microtrenching system according to claim 5, wherein the third hose support is configured to move from a storage position on the second motorized vehicle to a use a position in which the third hose support extends upward from a back portion of the second motorized vehicle.

7. A microtrenching system configured for continuously cutting a microtrench in a roadway and cleaning spoil from the microtrench comprising:

a first motorized vehicle comprising a spoil storage container and a vacuum device configured to form a vacuum in the spoil storage container;

a second motorized vehicle following the first motorized vehicle;

a microtrencher connected to the second motorized vehicle, the microtrencher having a cutting wheel configured to cut a microtrench in a roadway;

a vacuum shroud positioned behind the cutting wheel and configured to vacuum up the spoil created by the cutting wheel;

a vacuum hose having a first end and a second end, a first end of the vacuum hose connected to the spoil storage container, and the second end of the vacuum hose connected to the vacuum shroud; and a first hose support between the first motorized vehicle and second motorized vehicle configured for supporting the vacuum hose above a roadway surface, wherein the first hose support is configured to slide into a support storage container for storage and extend from the support storage container during use.

8. A microtrenching system configured for continuously cutting a microtrench in a roadway and cleaning spoil from the microtrench comprising:

a first motorized vehicle comprising a spoil storage container and a vacuum device configured to form a vacuum in the spoil storage container;

a second motorized vehicle following the first motorized vehicle;

a microtrencher connected to the second motorized vehicle, the microtrencher having a cutting wheel configured to cut a microtrench in a roadway;

a vacuum shroud positioned behind the cutting wheel and configured to vacuum up the spoil created by the cutting wheel;

a vacuum hose having a first end and a second end, a first end of the vacuum hose connected to the spoil storage container, and the second end of the vacuum hose connected to the vacuum shroud; and a first hose support between the first motorized vehicle and second motorized vehicle configured for supporting the vacuum hose above a roadway surface, wherein the first hose support is in the form of a removable ladder section configured to be removed from the first motorized vehicle and installed on a back of the first motorized vehicle.

9. A method of continuously cutting a microtrench in a roadway comprising:

providing a microtrenching system comprising a first motorized vehicle comprising a spoil storage container and a vacuum device configured to form a vacuum in the spoil storage container;

a second motorized vehicle following the first motorized vehicle;

a microtrencher connected to the second motorized vehicle, the microtrencher having a cutting wheel configured to cut a microtrench in a roadway;

a vacuum shroud positioned behind the cutting wheel and configured to vacuum up spoil created by the cutting wheel;

a vacuum hose having a first end and a second end, a first end of the vacuum hose connected to the spoil storage container, and the second end of the vacuum hose connected to the vacuum shroud; and a first hose support between the first motorized vehicle and the second motorized vehicle configured for supporting the vacuum hose above a roadway surface;

driving the first and second motorized vehicles forward while cutting the microtrench in the roadway with the cutting wheel to form the microtrench and the spoil;

supporting the vacuum hose between the first and second motorized vehicles using the first hose support so that the vacuum hose does not contact the roadway surface;

vacuuming the spoil through the shroud, through the vacuum hose, and into the spoil storage container; and a second hose support connected to the second vehicle and supporting the vacuum hose above a roadway surface by the second hose support.

10. The method according to claim 9, wherein the wherein the first hose support comprises a wheel and the wheel drives on the roadway surface.

11. The method according to claim 9, wherein the first hose support is connected to the first motorized vehicle and is configured to move from a storage position on the first motorized vehicle to a use position in which the first hose support extends from a back of the first motorized vehicle, the method further comprising moving the first hose support from the storage position into the use position to support the vacuum hose during cutting of the microtrench.

12. The method according to claim 9, wherein the second hose support is configured to move from a storage position on the second motorized vehicle to a use a position in which the second hose support extends upward from a front portion of the second motorized vehicle, the method further comprising moving the second hose support from the storage position into the use position to support the vacuum hose during cutting of the microtrench.

13. The method according to claim 9, wherein the first motorized vehicle comprises the second motorized vehicle and the microtrencher is connected to the first motorized vehicle by at least one vacuum hose support.

14. A method of continuously cutting a microtrench in a roadway comprising:

providing a microtrenching system comprising a first motorized vehicle comprising a spoil storage container and a vacuum device configured to form a vacuum in the spoil storage container;

a second motorized vehicle following the first motorized vehicle;

a microtrencher connected to the second motorized vehicle, the microtrencher having a cutting wheel configured to cut a microtrench in a roadway;

a vacuum shroud positioned behind the cutting wheel and configured to vacuum up spoil created by the cutting wheel;

a vacuum hose having a first end and a second end, a first end of the vacuum hose connected to the spoil storage container, and the second end of the vacuum hose connected to the vacuum shroud; and a first hose support between the first motorized vehicle and the second motorized vehicle configured for supporting the vacuum hose above a roadway surface;

driving the first and second motorized vehicles forward while cutting the microtrench in the roadway with the cutting wheel to form the microtrench and the spoil;

supporting the vacuum hose between the first and second motorized vehicles using the first hose support so that the vacuum hose does not contact the roadway surface;

vacuuming the spoil through the shroud, through the vacuum hose, and into the spoil storage container; and a third hose support connected to the second vehicle and supporting the vacuum hose above a roadway surface by the third hose support.

15. The method according to claim 14, wherein the third hose support is configured to move from a storage position on the second motorized vehicle to a use a position in which the third hose support extends upward from a back portion of the second motorized vehicle, the method further comprising moving the third hose support from the storage position into the use position to support the vacuum hose during cutting of the microtrench.

16. A method of continuously cutting a microtrench in a roadway comprising:

providing a microtrenching system comprising a first motorized vehicle comprising a spoil storage container and a vacuum device configured to form a vacuum in the spoil storage container;

a second motorized vehicle following the first motorized vehicle;

a microtrencher connected to the second motorized vehicle, the microtrencher having a cutting wheel configured to cut a microtrench in a roadway;

a vacuum shroud positioned behind the cutting wheel and configured to vacuum up spoil created by the cutting wheel;

a vacuum hose having a first end and a second end, a first end of the vacuum hose connected to the spoil storage container, and the second end of the vacuum hose connected to the vacuum shroud; and a first hose support between the first motorized vehicle and the second motorized vehicle configured for supporting the vacuum hose above a roadway surface;

driving the first and second motorized vehicles forward while cutting the microtrench in the roadway with the cutting wheel to form the microtrench and the spoil;

supporting the vacuum hose between the first and second motorized vehicles using the first hose support so that the vacuum hose does not contact the roadway surface; and vacuuming the spoil through the shroud, through the vacuum hose, and into the spoil storage container, wherein the first hose support is configured to slide into a support storage container for storage and extend from the support storage container during use, the method further comprising extending the first hose support from the support storage container.

17. A method of continuously cutting a microtrench in a roadway comprising:

providing a microtrenching system comprising a first motorized vehicle comprising a spoil storage container and a vacuum device configured to form a vacuum in the spoil storage container;

a second motorized vehicle following the first motorized vehicle;

a microtrencher connected to the second motorized vehicle, the microtrencher having a cutting wheel configured to cut a microtrench in a roadway;

a vacuum shroud positioned behind the cutting wheel and configured to vacuum up spoil created by the cutting wheel;

a vacuum hose having a first end and a second end, a first end of the vacuum hose connected to the spoil storage container, and the second end of the vacuum hose connected to the vacuum shroud; and a first hose support between the first motorized vehicle and the second motorized vehicle configured for supporting the vacuum hose above a roadway surface;

driving the first and second motorized vehicles forward while cutting the microtrench in the roadway with the cutting wheel to form the microtrench and the spoil;

supporting the vacuum hose between the first and second motorized vehicles using the first hose support so that the vacuum hose does not contact the roadway surface; and vacuuming the spoil through the shroud, through the vacuum hose, and into the spoil storage container, wherein the first hose support is in the form of a removable ladder section configured to be removed from the first motorized vehicle and installed on a back of the first motorized vehicle, the method further comprising removing the first hose support from the first motorized vehicle and installing the first hose support to the back of the first motorized vehicle.

* * * * *